United States Patent [19]

Desmond

[11] Patent Number: 4,546,912

[45] Date of Patent: Oct. 15, 1985

[54] CARTON LID WITH ROUNDED CORNERS

[75] Inventor: John D. Desmond, Philadelphia, Pa.

[73] Assignee: Container Corporation of America, Chicago, Ill.

[21] Appl. No.: 696,393

[22] Filed: Jan. 30, 1985

[51] Int. Cl.[4] ..... B65D 5/20

[52] U.S. Cl. ..... 229/30; 229/31 R; 229/32; 229/37 R; 229/43

[58] Field of Search ..... 229/24, 31 R, 30, 32, 229/37 R, 43

[56] References Cited

U.S. PATENT DOCUMENTS 4,046,310 9/1977 Gustafsson ..... 229/30
4,049,188 9/1977 Persson ..... 220/418

FOREIGN PATENT DOCUMENTS 501259 11/1954 Italy ..... 229/32
27893 1/1913 United Kingdom ..... 229/32

*Primary Examiner*—Joseph Man-Fu Moy
*Attorney, Agent, or Firm*—Richard W. Carpenter

[57] ABSTRACT

A liquid-tight paperboard carton lid having a flat top wall and having flat side and end walls joined to each other by rounded corners.

7 Claims, 6 Drawing Figures

CARTON LID WITH ROUNDED CORNERS

BACKGROUND OF THE INVENTION

1. Field of the Invention

This invention relates generally to folding carton lids, and more particularly to a liquid-tight carton lid having rounded corners for use with a carton of a similar shape.

2. Description of the Prior Art

Applicant is unaware of any prior art patent that discloses a one-piece, liquid-tight, paperboard carton lid having an absolutely flat top wall with flat side and end walls and rounded corners formed in the manner of the present invention.

SUMMARY OF THE INVENTION

It is an object of the present invention to provide a one-piece paperboard carton lid having flat side and end walls joined to each other by rounded corners.

A more specific object of the invention is the provision, in a carton of the type described, of a liquid-tight corner construction.

These and other objects of the invention will be apparent from an examination of the following description and drawings.

It will be understood that, for purposes of clarity, certain elements may have been intentionally omitted from certain views where there are believed to be illustrated to better advantage in other views.

DESCRIPTION OF THE PREFERRED EMBODIMENT

Figure 1:
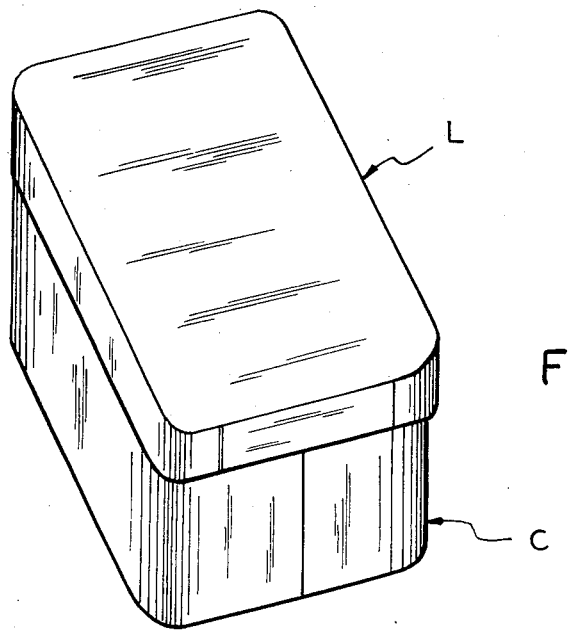
FIG. 1 is a perspective view of a carton lid embodying features of the invention, shown with a carton having a similar contour.
Figure 6:
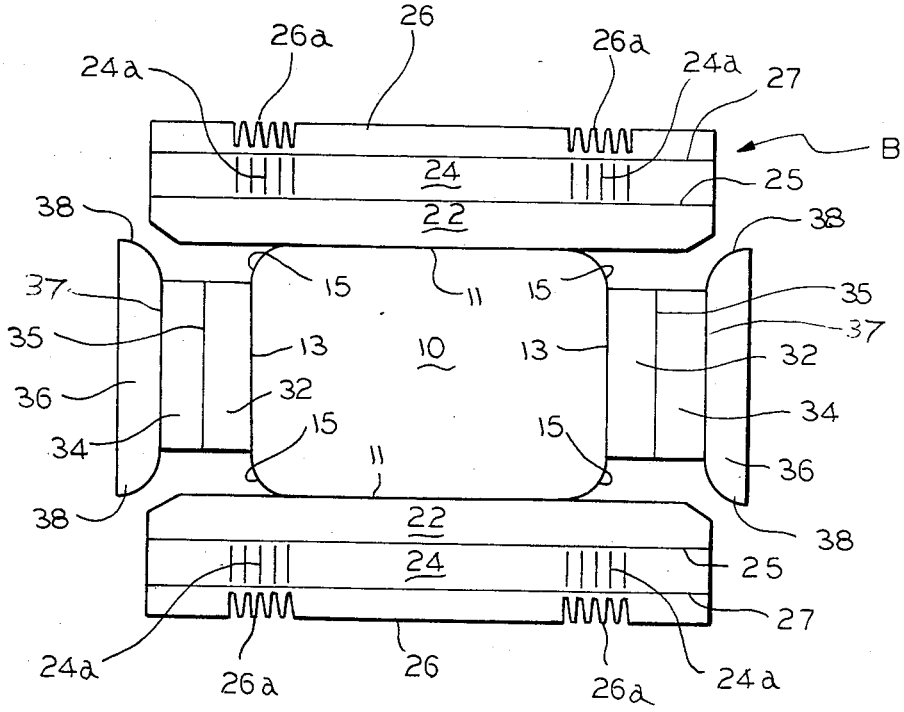
FIG. 6 is a plan view of a blank of foldable sheet material from which the lid illustrated in the other views may be formed.
Figure 4:
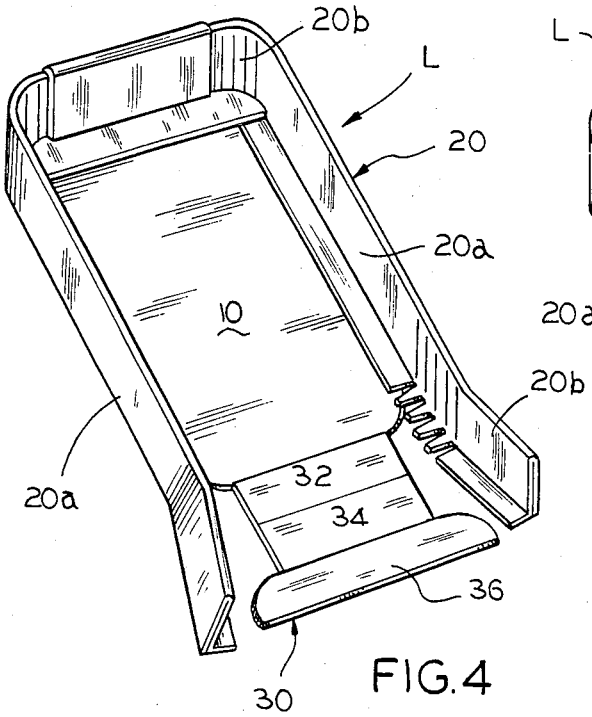
FIGS. 4 and 5 are views similar to FIG. 3 but illustrate different steps in the erection of the carton lid.
Figure 5:
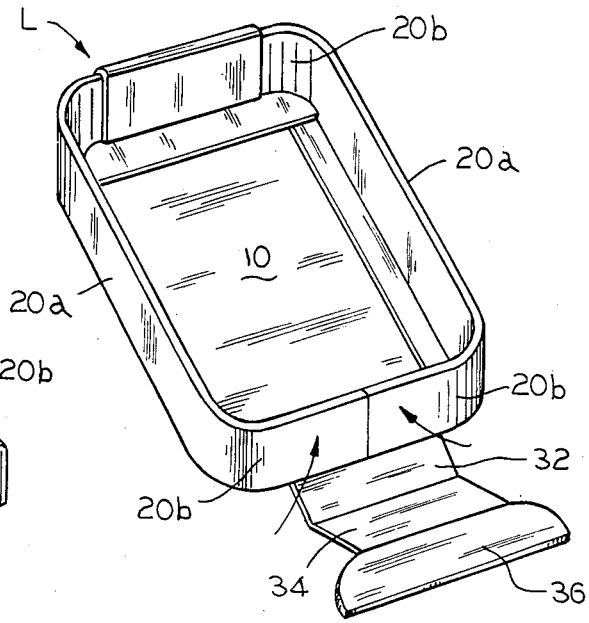
Figure 3:
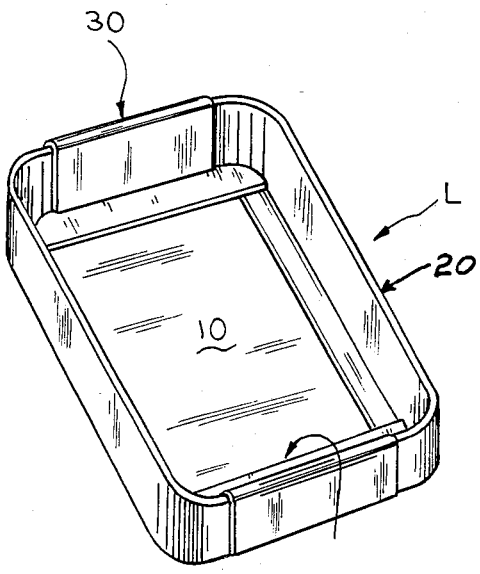
FIG. 3 is an inverted perspective view of the carton lid illustrated in the previous views.
Figure 2:
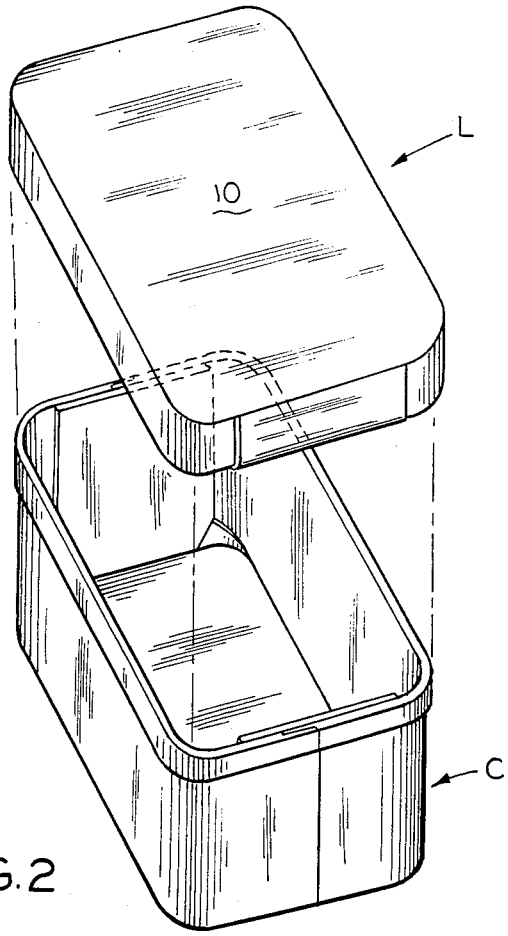
FIG. 2 is an exploded perspective view of the structure illustrated in FIG. 1.

Referring now to the drawings for a better understanding of the invention, it will be seen that the novel lid, indicated generally at L in FIG. 3, may be formed from a unitary blank B of foldable sheet material, such as coated paperboard, illustrated in FIG. 6.

Lid L includes a main or top panel 10 having opposed straight side edges 11 and opposed straight end edges 13 which are connected to each other by rounded corner edges 15.

Connected to the sides of top wall panel 10 are a pair of side walls 20 each of which has a center portion 20*a* and a pair of end portions 20*b*.

The side walls each include an outer panel 22 which is foldably joined at its upper edge to top wall panel 10 along a related side edge 11 thereof. Each side wall outer panel 22 has foldably joined to its lower edge, along a fold line 25, an inner panel 24 which is folded 180 degrees about the fold line 25 so as to lie in face-to-face relation with the inner surface of the outer panel 22.

Each of the outer panels 22 has foldably joined to its upper edge, along a fold line 27, a retaining flange 26 which is disposed to be folded inwardly at right angles to the retaining flange so as to lie against the inner or lower surface of top wall panel 10 and be secured with respect thereto in any desired manner.

In order to permit the end portions 20*b* of the side walls to be folded around the corners of the top wall panel 10 so as to lie over the corner edges 15 there may be provided, in the area adjacent the corner edges of the top wall panel, a plurality of transversely extending scores 24*a* in side wall inner panels 24 and a plurality of transversely extending notches 26*a* in the retaining flanges 26.

At each end of the carton lid there is provided an end wall 30 which includes an outer panel 32 foldably joined at its upper edges to the related end edge 13 of the top wall panel 10.

Each end wall outer panel 32 has foldably joined to its lower edge, along a fold line 35, an inner panel 34. Each end wall inner panel 34 has in turn foldably joined to its upper edge, along fold line 37, a retaining flange 36 which is slightly longer than panels 32 and 34, because it has extensions 38 extending outwardly from the ends thereof beyond panels 32 and 34.

In erecting the carton lid L, the end portions of the side walls 20 are folded around the ends of the carton so as to overlie the top wall panel corner edges 15 and end edges 13 and be secured between the outer and inner panels 32 and 34 of the respective end walls 20.

The retaining flanges 36 of each of the end walls are disposed to be folded inwardly at right angles to the inner panels so as to lie against and be secured with respect to the inner or lower surface of top wall panel 10.

Thus, the end walls keep the end portions of the side walls in place and the scores and notches in the side walls permit them to be curved around to match the contour of the carton top wall and at the same time provide a liquid-tight corner construction for the carton lid.

What is claimed is:

1. A liquid-tight carton lid having a flat top wall and having flat side and end walls joined to each other by rounded corners, said lid being formed from a unitary blank of foldably sheet material such as coated paperboard and comprising:

(a) a top wall panel having pairs of opposed parallel, straight side and end edges joined by rounded corner edges;

(b) a pair of opposed side walls having center portions foldably joined at upper edges to respective side edges of said top wall panel and extending downwardly therefrom;

(c) said side walls having end portions extending beyond said center portions under said top wall panel corner and end edges into overlapping relation with each other;

(d) a pair of opposed end walls joined to respective end edges of said top wall panel and enclosing related side wall end portions;

(e) each of said end walls including;

(i) an outer panel foldably joined at its upper edge to an end edge of said top wall panel;

(ii) an inner panel foldably joined at a lower edge to a lower edge of said outer panel;

(iii) a retaining flange foldably joined at an upper edge of said inner panel and being folded inwardly and secured with respect to an inner surface of said top wall panel;

(f) each of said side walls including:

(i) an outer panel joined at an upper edge to a side edge of said top wall panel;

(ii) an inner panel foldably joined at a lower edge to a lower edge of said outer panel;

(iii) a retaining flange foldably joined at an upper edge to an upper edge of said inner panel and being folded inwardly and secured with respect to an inner surface of said top wall panel;

(iv) said inner panel including a plurality of vertically disposed scores and said retaining flange including a plurality of notches in the area of said carton corner to permit said side wall end portion to be curved around the corner edge between the side and end edges of said top wall panel;

(g) said side wall end portions being interposed between and secured with respect to the outer and inner panels of the related end walls.

2. A liquid-tight carton lid having a flat top wall and having flat side and end walls joined to each other by rounded corners, said lid being formed from a unitary blank of foldably sheet material such as coated paperboard and comprising:

(a) a top wall panel having pairs of opposed parallel, straight side and end edges joined by rounded corner edges;

(b) a pair of opposed side walls having center portions foldably joined at upper edges to respective side edges of said top wall panel and extending downwardly therefrom;

(c) said side walls having end portions extending beyond said center portions under said top wall panel corner and end edges into overlapping relation with each other;

(d) a pair of opposed end walls joined to respective end edges of said top wall panel and enclosing related side wall end portions;

(e) each of said end walls including:

(i) an outer panel foldably joined at its upper edge to an end edge of said top wall panel;

(ii) an inner panel foldably joined at a lower edge to a lower edge of said outer panel;

(f) each of said side walls including:

(i) an outer panel joined to said top wall panel;

(ii) an inner panel foldably joined at a lower edge to said outer panel;

(iii) said retaining flange including a plurality of notches in the area of said carton corner to permit said side wall end portion to be curved around the corner edge between the side and end edges of said top wall panel;

(g) said side wall end portions being interposed between and secured with respect to the outer and inner panels of the related end walls.

3. A unitary blank of foldable sheet material, such as coated paperboard which is cut and scored to provide a liquid-tight carton lid having a flat top wall and having flat side and end walls joined to each other by rounded corners, said blank comprising:

(a) a top wall panel having pairs of opposed parallel, straight side and end edges joined by rounded corner edges;

(b) said side walls having center portions and end portions beyond said center portions;

(c) a pair of opposed end wall forming sections, each including:

(i) an outer panel foldably joined at its inner edge to an end edge of said top wall panel;

(ii) an inner panel foldably joined at its inner edge to an outer edge of said outer panel;

(iii) a retaining flange foldably joined at its inner edge to an outer edge of said inner panel;

(d) a pair of side wall forming sections each including:

(i) an outer panel joined at its inner edge to a side edge of said top wall panel;

(ii) an inner panel foldably joined at its inner edge to an outer edge of said outer panel;

(iii) a retaining flange foldably joined at its inner edge to an outer edge of said inner panel;

(iv) said inner panel including a plurality of vertically disposed scores and said retaining flange including a plurality of notches in the area adjacent said carton corner to permit said side wall end portion to be curved around the corner edge between the side and end edges of said top wall panel when the carton is erected.

4. A carton according to claim 2, and including a retaining flange foldably joined to an upper edge of said end wall inner panel and being folded inwardly and secured with respect to an inner surface of said top wall panel.

5. A carton according claim 2, and including a retaining flange foldably joined to an upper edge of said side wall inner panel and being folded inwardly and secured with respect to an inner surface of said top wall panel.

6. A carton according to claim 2, wherein said side wall inner panel includes a plurality of transverse scores to permit said side wall end portion to be curved around said corner edge of said top wall panel.

7. A carton according to claim 2, wherein said side wall retaining flange includes a plurality of transverse notches to permit said side wall end portion to be curved around said corner edge of said top wall panel.

* * * * *